US012004560B1

(12) United States Patent
Beal

(10) Patent No.: US 12,004,560 B1
(45) Date of Patent: Jun. 11, 2024

(54) SMOKING STORAGE DEVICE

(71) Applicant: Dan Beal, Baraboo, WI (US)

(72) Inventor: Dan Beal, Baraboo, WI (US)

( * ) Notice: Subject to any disclaimer, the term of this patent is extended or adjusted under 35 U.S.C. 154(b) by 0 days.

(21) Appl. No.: 18/348,686

(22) Filed: Jul. 7, 2023

Related U.S. Application Data

(60) Provisional application No. 63/447,163, filed on Feb. 21, 2023.

(51) Int. Cl.

| | |
|---|---|
| ***A24F 23/04*** | (2006.01) |
| ***A24F 1/28*** | (2006.01) |
| ***A24F 9/06*** | (2006.01) |
| ***A24F 9/16*** | (2006.01) |

(52) U.S. Cl.
CPC ..... *A24F 23/04* (2013.01); *A24F 1/28* (2013.01); *A24F 9/06* (2013.01); *A24F 9/16* (2013.01)

(58) Field of Classification Search
CPC .... A24F 23/04; A24F 1/28; A24F 9/06; A24F 9/16; A24F 15/12; A24F 15/18; A24F 15/20; A24F 15/10
USPC ..... 206/236; 220/823
See application file for complete search history.

(56) References Cited

U.S. PATENT DOCUMENTS

| | | | | |
|---|---|---|---|---|
| 1,134,524 | A * | 4/1915 | Fowler | B65D 25/04 220/823 |
| 10,206,425 | B2 | 2/2019 | Breiwa, III | |
| 10,842,193 | B2 * | 11/2020 | Sahin | A24F 40/30 |
| 11,191,921 | B1 | 12/2021 | Hudgins et al. | |
| 11,213,073 | B2 | 1/2022 | Breiwa, III et al. | |
| 2017/0035105 | A1 * | 2/2017 | Jordan | A24F 9/08 |
| 2022/0087327 | A1 | 3/2022 | Breiwa | |

FOREIGN PATENT DOCUMENTS

JP H0633495 U * 5/1994

* cited by examiner

*Primary Examiner* — Andrew D Perreault
(74) *Attorney, Agent, or Firm* — Eric Karich; Karich & Associates

(57) ABSTRACT

A smoking storage device has an elongate housing with a top end and a bottom end, the top end having openings into a lighter receiving chamber, a pipe receiving chamber, and a smoking product receiving chamber, and wherein the bottom end is closed. The lighter receiving chamber is sized and shaped to receive a lighter, the pipe receiving chamber is adapted to receive and store an elongate smoking pipe, and the smoking product receiving chamber is adapted to receive and store a smoking product. An overcap is pivotally mounted adjacent the top end of the elongate rigid housing pivots between a closed position and an open position.

11 Claims, 6 Drawing Sheets

SMOKING STORAGE DEVICE

CROSS-REFERENCE TO RELATED APPLICATIONS

This application for a utility patent claims the benefit of U.S. Provisional Application No. 63/447,163 filed Feb. 21, 2023.

BACKGROUND OF THE INVENTION

Field of the Invention

This invention relates generally to smoking devices and accessories, and more particularly to a smoking storage device for holding various smoking accessories in a single easy-to-use unit.

Description of Related Art

Breiwa, U.S. Pat. No. 10,206,425, teaches an exothermal vaporizer. The exothermal vaporizer has a body including an air and vapor mix port, a fluid inlet port in communication with a reservoir, an air inlet, and a wicking material. A mouthpiece is coupled to the body and a temperature indicating cap is removable from the body. A counter flow design exothermal vaporizer, a modular exothermal vaporizer, and a vaporizer which is adjustable to modulate and/or regulate the flow ratio of dilution air and produced vapor are also disclosed.

Hudgins, U.S. Pat. No. 11,191,921, teaches a convection aromatherapy device. The device has a body made of a suitable material, an air path for transfer of heat, and an electric cartridge heater. A source of heat, and/or hot air and device or means for selective vaporization of desirable compounds from various materials is thereby provided. A kit for convection aromatherapy is also provided.

Breiwa, U.S. Pat. No. 11,213,073, teaches a volatizer including a multifunction cap secured over the open end of a body or other device, the chamber or other part of the device holding an amount of material to be extracted by selective volatization therein and including a thermo-indicator thereon or therein capable of deforming, actuating or otherwise indicating upon heating to a preselected temperature to provide an indication of the proper temperature for volatilization and extraction of the selected and or target compound from the material within the device.

Breiwa, U.S. 2022/0087327, teaches an indirect exothermal vaporization matrix for selective vaporization and/or atomization of compounds. The matrix may incorporate any one or more of the following features: capillary structures, vapor relief pathways, carbon filtering, recessed receiving areas, torus and tori geometry to provide uniform loading and/or reloading of the indirect exothermal vaporization matrix with various compounds, and the like.

The prior art teaches storage devices and vaporization devices. However, the prior art does not teach an all-in-one storage device adapted to allow smoking and/or vaporization of smoking product using only stored components. The present invention fulfills these needs and provides further advantages as described in the following summary.

SUMMARY OF THE INVENTION

The present invention teaches certain benefits in construction and use which give rise to the objectives described below.

The present invention provides a smoking storage device for storing a lighter and a smoking product. The smoking storage device comprises an elongate housing having a top end and a bottom end, the top end having openings into a lighter receiving chamber, a pipe receiving chamber, and a smoking product receiving chamber, and wherein the bottom end is closed. The lighter receiving chamber is sized and shaped to receive the lighter, the pipe receiving chamber is adapted to receive and store an elongate smoking pipe, and the smoking product receiving chamber is adapted to receive and store the smoking product. An overcap is pivotally mounted adjacent the top end of the elongate rigid housing, wherein the overcap pivots between a closed position and an open position. In the closed position the overcap covers the opening of the pipe receiving chamber and the smoking product receiving chamber to hold the elongate smoking pipe and the smoking product within their respective chambers, and in the open position the overcap does not cover the openings and allows access to the elongate smoking pipe and the smoking product.

A primary objective of the present invention is to provide a smoking storage device having advantages not taught by the prior art.

Another objective is to provide a smoking storage device having a plurality of chambers for compactly holding smoking/vaping product and smoking/vaping accessories.

A further objective is to provide a smoking storage device having an overcap that can be opened using only one hand to access items stored within the device.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention.

DETAILED DESCRIPTION OF THE INVENTION

The above-described drawing figures illustrate the invention, a smoking storage device that stores a plurality of smoking related supplies and accessories. The smoking storage device is configured to enable easy use of the smoking related supplies and accessories, as discussed in greater detail below.

For the purposes of this application, the term "smoking" is defined to include any form of combusting or vaporizing an inhalable product, including marijuana, tobacco, and any other product known in the art.

Figure 1:
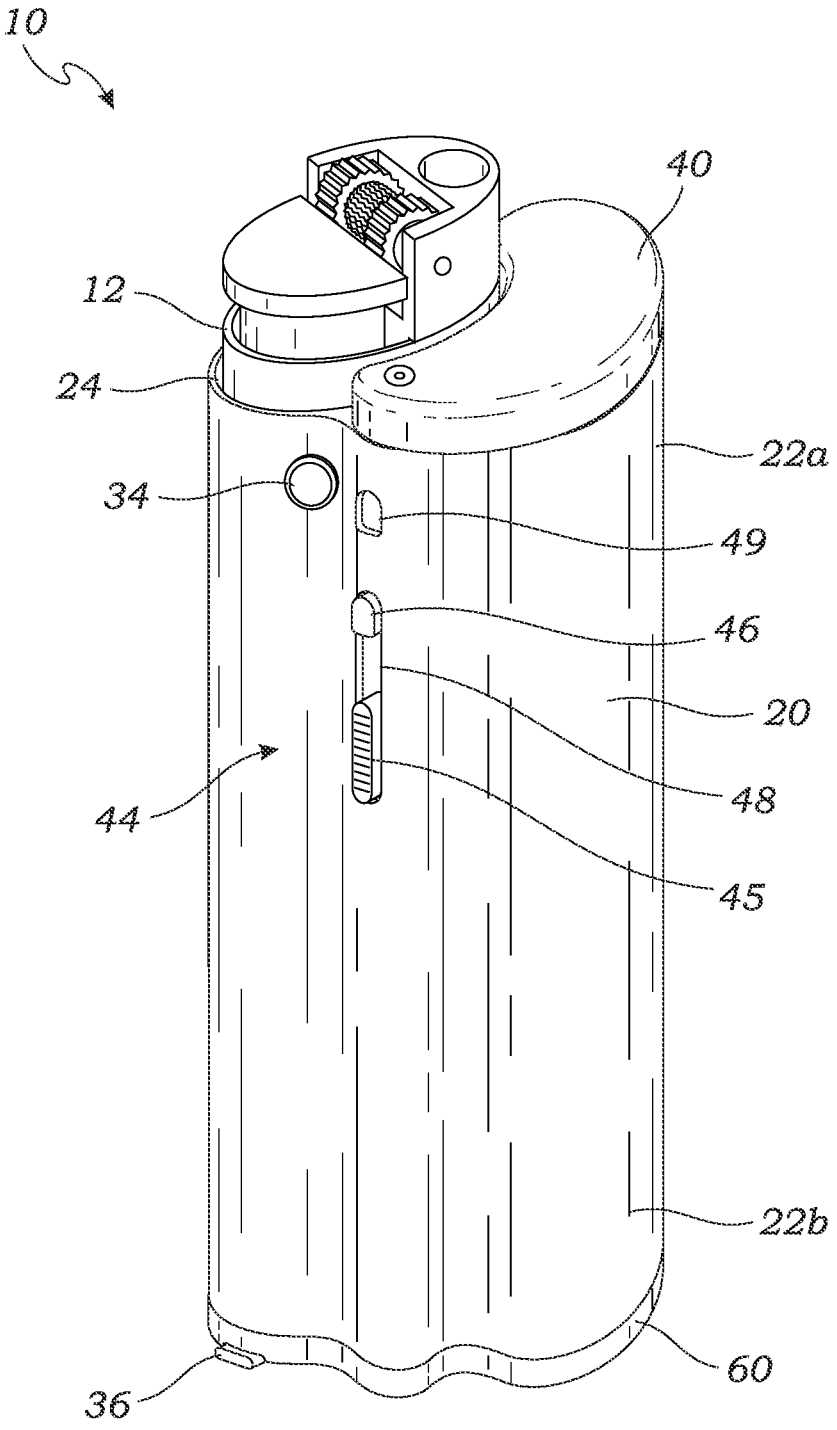
FIG. 1 is a perspective view of a smoking storage device according to one embodiment of the present invention, illustrating a lighter in the device, and illustrating an overcap in a closed position.
Figure 2:
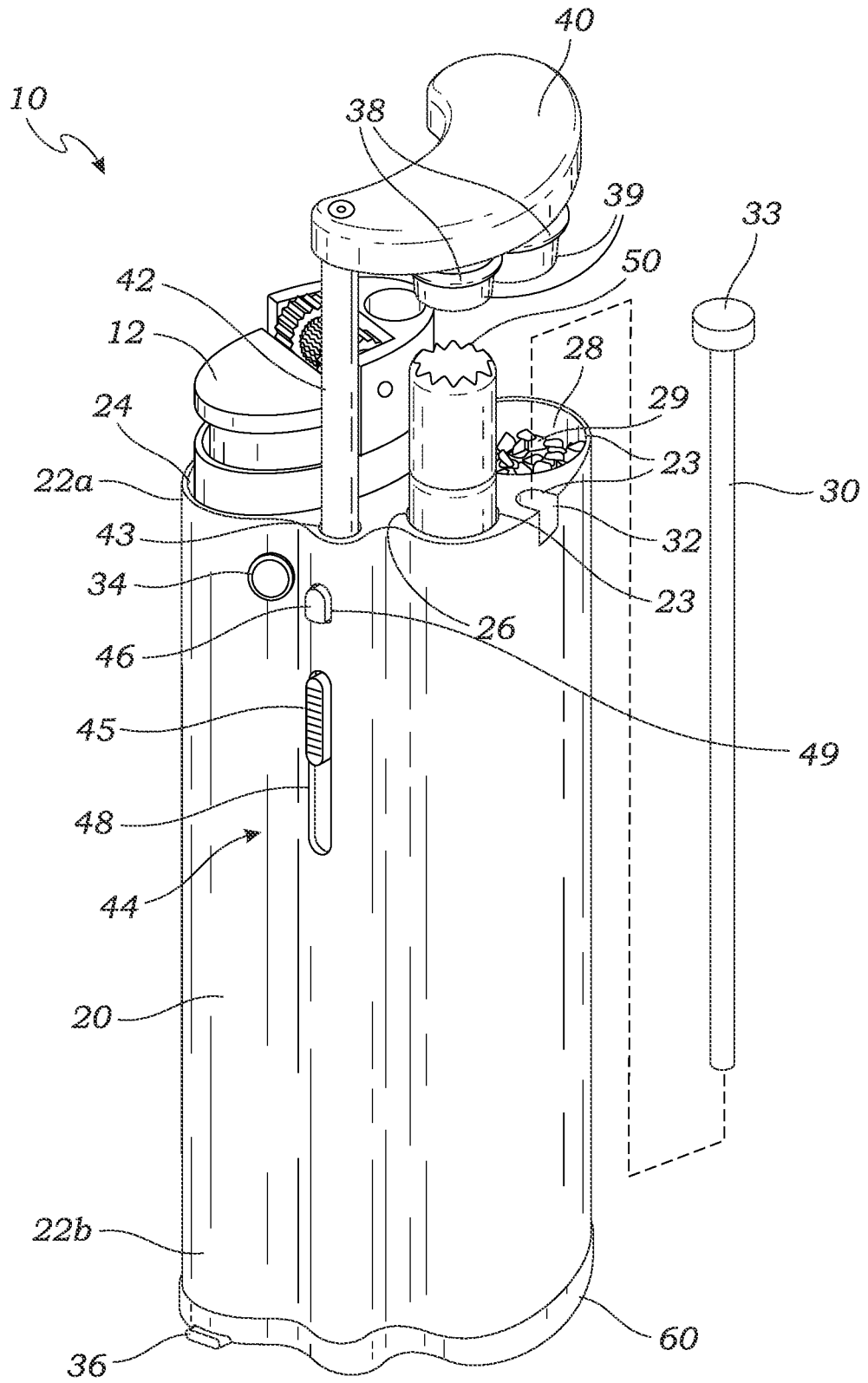
FIG. 2 is a perspective view of the smoking storage device of FIG. 1, illustrating the overcap in an open position to expose a elongate smoking pipe and a supply of smoking material, and also illustrating an elongate cleaning tool exploded from the device.

FIG. 1 is a perspective view of a smoking storage device 10 according to one embodiment of the present invention, illustrating a lighter 12 in the device 10, and illustrating an overcap 40 in a closed position. FIG. 2 is a perspective view of the smoking storage device 10, showing the overcap 40 in an open position. As shown in FIGS. 1-2, the smoking storage device 10 comprises an elongate housing 20 having a top end 22*a* and a bottom end 22*b*, wherein the top end 22*a* includes openings 23 into a lighter receiving chamber 24, a pipe receiving chamber 26, and a smoking product receiving chamber 28, and wherein the bottom end 22*b* is closed.

As shown in FIGS. 1-2, the lighter receiving chamber 24 is sized and adapted to receive and store the lighter 12, the pipe receiving chamber 26 is adapted to receive and store an elongate smoking pipe 50, and the smoking product receiving chamber 28 is adapted to receive and store smoking product 29, each discussed in greater detail below. In some embodiments, an elongate cleaning tool 30 is adapted to be stored in a rod storage chamber 32, slot, or other suitable structure. A head 33 of the elongate cleaning tool 30 may be grasped to pull it from the elongate housing 20 for use in clearing out the elongate smoking pipe 50, discussed further below.

In some embodiments, the elongate housing 20 is constructed of a rigid material, (e.g., plastic, metal, or other suitable material), but in other embodiments may be fully or partially constructed of semi-rigid material(s) (e.g., silicone, rubber, flexible plastic, etc.). The elongate housing 20 may further be an extruded construction, wherein the pipe receiving chamber 26 and the smoking product receiving chamber 28 are cylindrical in shape, abut one another, and are arranged along axes which are all parallel with each other. In some embodiments, the lighter receiving chamber 24 may abut both the pipe receiving chamber 26 and the smoking product receiving chamber 28, but the lighter receiving chamber 24 has an offset-cylindrical cross-section that is sized and shaped to coincide with the shape of a typical lighter. However, other shapes may be formulated, to adapt to various types of accessories and storage needs. For example, a torch lighter may be used instead of a standard lighter, or any other related heating tool may be used.

In this embodiment, the lighter 12 may be inserted into the lighter receiving chamber 24 where it frictionally engages the lighter receiving chamber 24 so that it does not fall out without intentional force being applied to overcome the frictional engagement. As shown in FIGS. 1-2, the main housing 20 may include a resilient plug 34 that extends through an opening in the elongate housing 20 and into the lighter receiving chamber 24, so that the resilient plug 34 abuts and frictionally engages the lighter 12 to prevent the lighter 12 from accidentally falling out of the lighter receiving chamber 24. In some applications, the resilient plug 34 may be pulled partially or entirely out of the main housing 20, so the lighter 12 may be disengaged from the lighter receiving chamber 24. Furthermore, a tab or foot 36 adjacent the bottom end 22*b* of the main housing 20 may similarly be used to push the lighter 12 upwardly out of the chamber. Alternatives may be implemented, e.g., a slot or aperture for a human thumb to directly push the lighter 12 upwardly, or any other similar alternatives for frictional disengagement. Furthermore, the lighter receiving chamber 24 may be configured to secure the lighter 12 without a snug/frictional fit, using any form of pin, lock, fastener, etc.

As shown in FIGS. 1-2, the overcap 40 is pivotally mounted adjacent the top end 22*a* of the elongate housing, wherein the overcap 40 pivots between a closed position and an open position. In some embodiments, the overcap 40 is pivotally mounted on the top end 22*a* of the elongate housing 20 via a mounting rod 42 wherein the mounting rod 42 slidably engages a mounting rod chamber 43 of the elongate housing 20. The mounting rod 42 may include a locking feature 44 for locking the mounting rod 42 in a lowered position, and for releasing the mounting rod 42 so that the overcap 40 can move upwardly for pivoting.

As shown in FIGS. 1-2, the locking feature 44 of this embodiment includes a lateral protrusion (or button) 45 that protrude out of a slot 48 formed in the main housing 20. The lateral protrusion 45 is formed on a resilient arm 41 (shown in FIG. 4) that is formed to extend from the mounting rod 42, so that the lateral protrusion 45 can be pressed inwardly to an unlocked position, and it will resiliently return to a locked position. The resilient arm 41 may also include a lateral stop 46 that also extends outwardly.

In use, a user presses the lateral protrusion (or button) 45 inwardly, causing the lateral stop 46 to also be pressed inwardly, so that the mounting rod 42 may move upwardly, wherein the lateral stop 46 will snap into a locking aperture 48 formed in the main body above the slot 48, to prevent the mounting rod 42 from coming entirely out of the mounting rod chamber 43. The lateral protrusion (or button) 45 may then be pressed inwardly and pulled downwardly so that the lateral stop 46 snaps back into the slot 48 and the overcap 40 is returned to the closed position. In other embodiments, alternative forms of the locking feature 44 may be used, using similar buttons, screws, locking pins, and other mechanical or non-mechanical locking mechanisms known in the art, and these other known mechanisms should be considered within the scope of the present invention.

Figure 4:
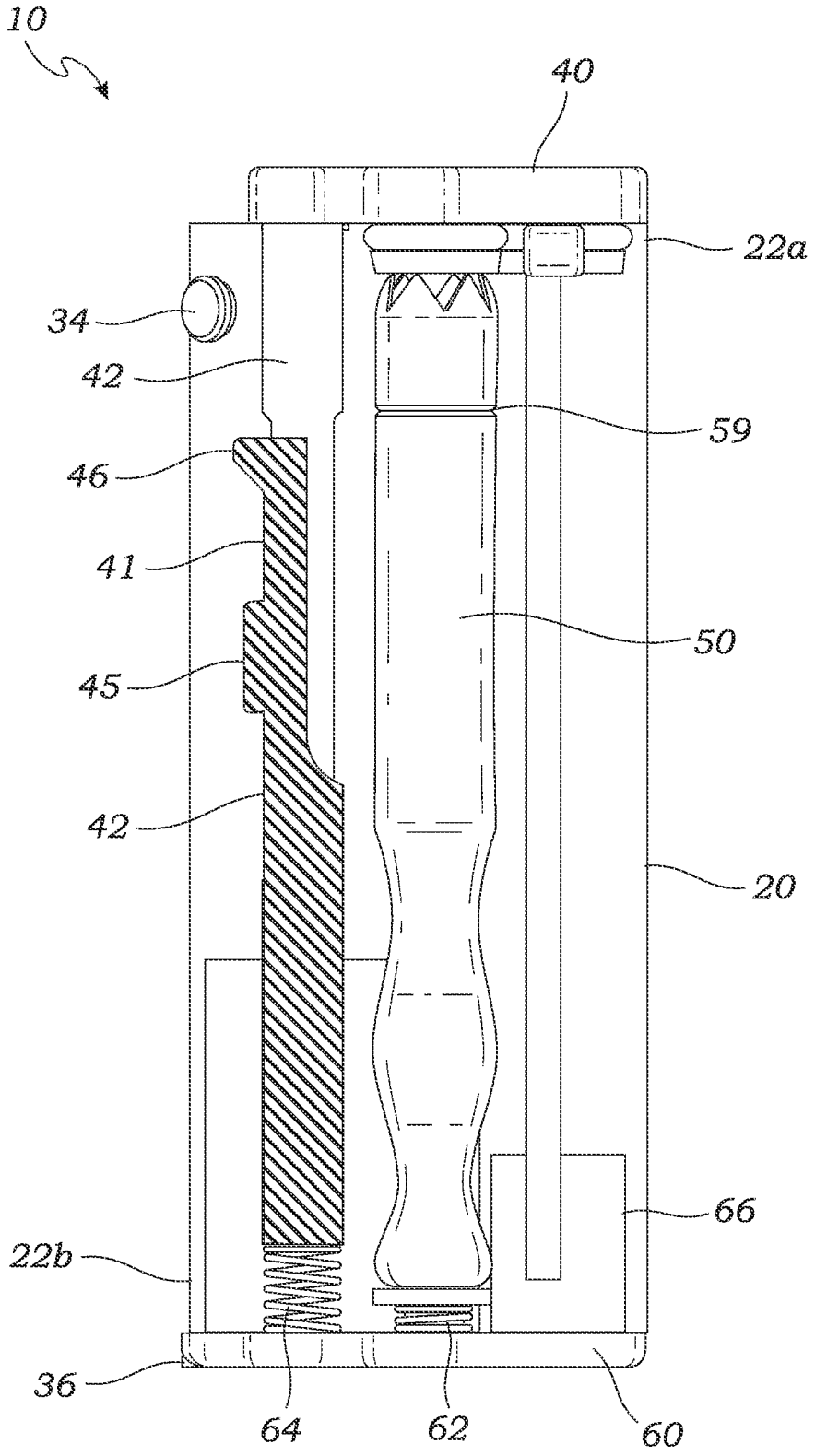
FIG. 4 is a side elevation sectional view of the smoking storage device.
Figure 5:
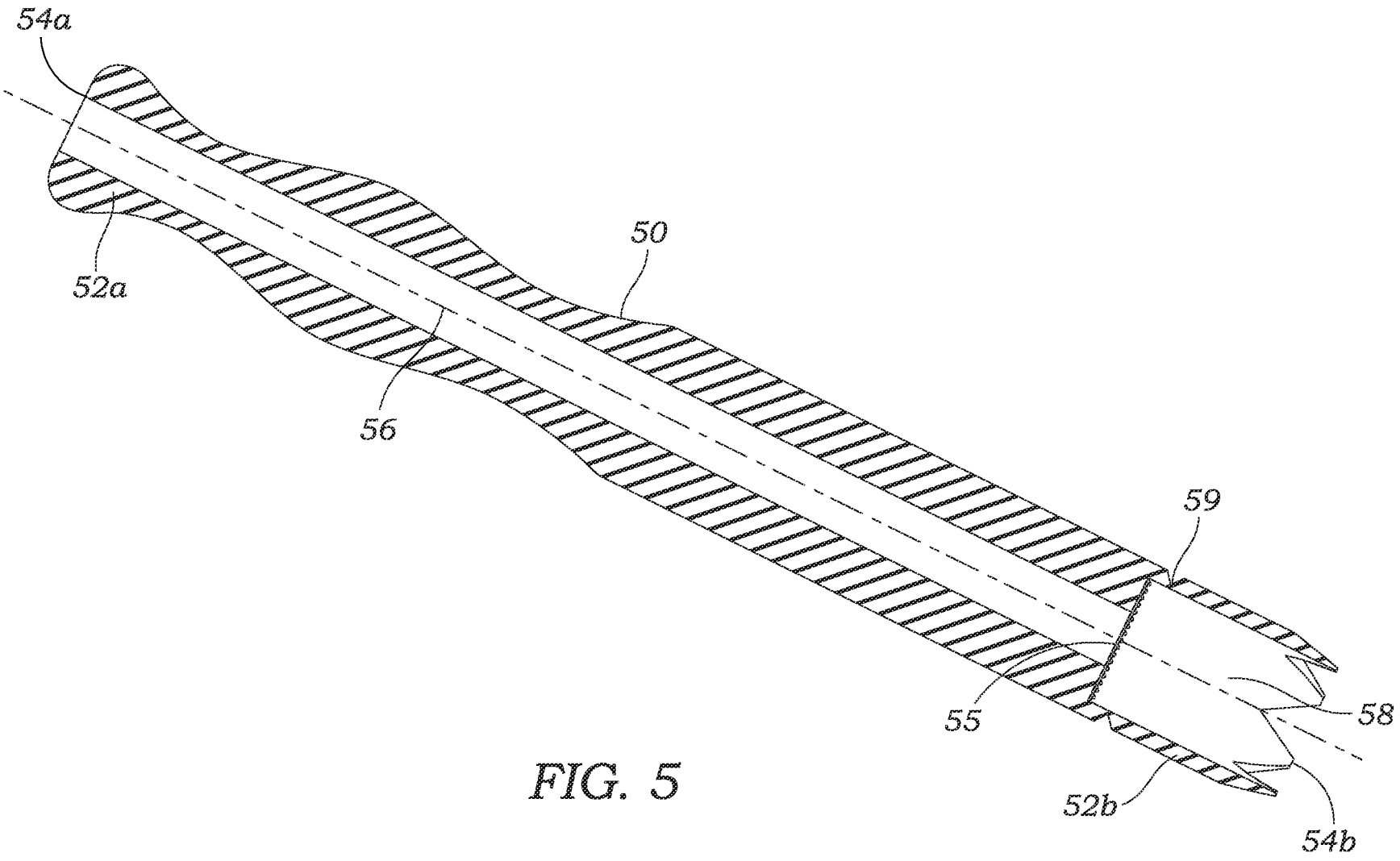
FIG. 5 is a side elevation sectional view of an elongate smoking pipe of the smoking storage device.
Figure 6:
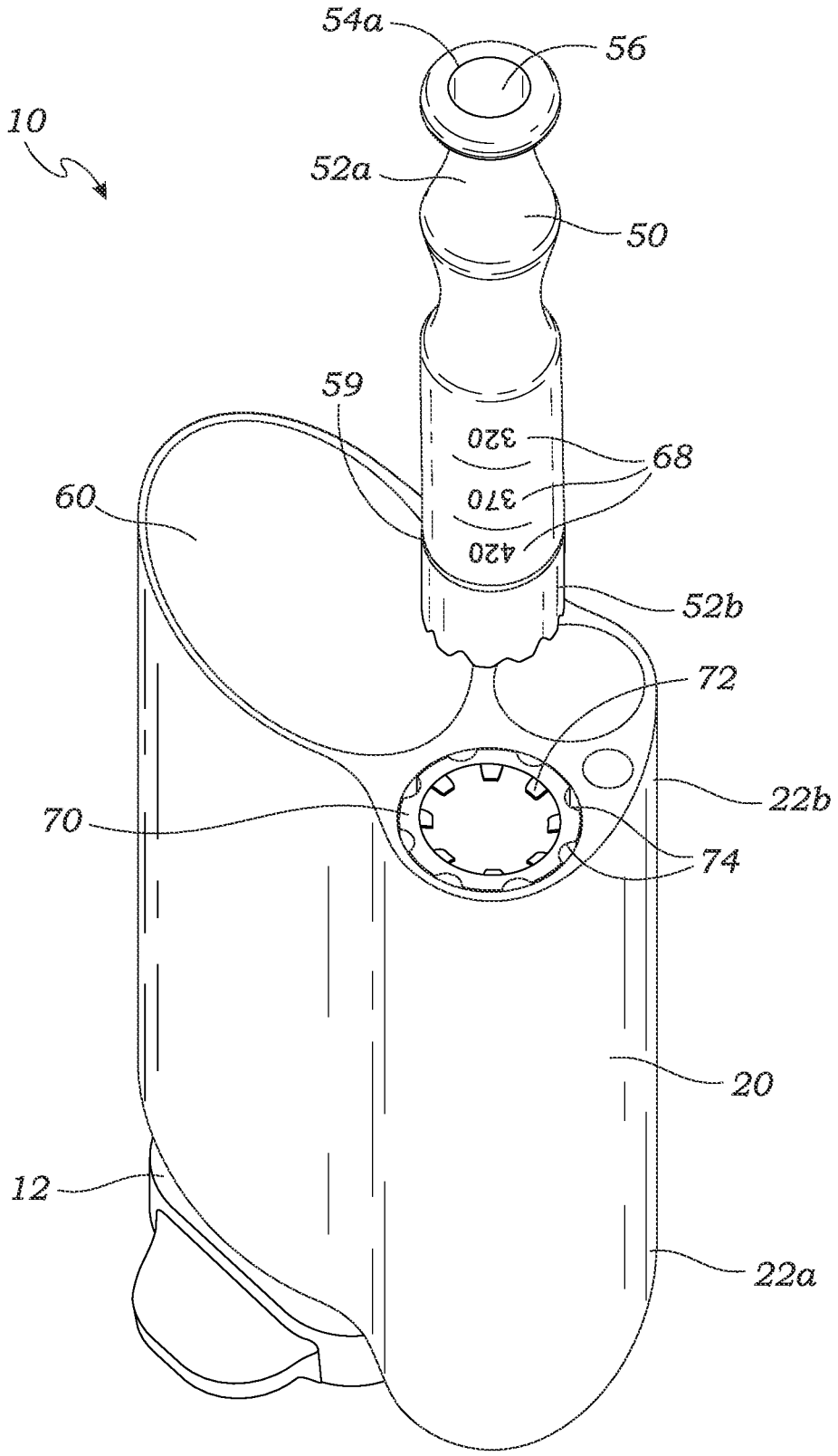
FIG. 6 is a bottom perspective view of the smoking storage device, illustrating the elongate smoking pipe being inserted into a vape cap of the smoking storage device.

As shown in FIG. 2, once the overcap 40 has been raised, the elongate smoking pipe 50 may also pop upwardly, so it is partially out of the pipe receiving chamber 26 and may be readily grasped and removed by the user. As shown in FIG. 2, in the open position the overcap does not cover the openings 23 and allows access to the elongate smoking pipe 50 and the smoking product 29. As shown in FIG. 1, in the closed position the overcap 40 covers the openings 23 of the pipe receiving chamber 26 and the smoking product receiving chamber 28 to hold the elongate smoking pipe 50 and the smoking product 29 within their respective chambers. As shown in FIG. 2, in this embodiment, the elongate smoking pipe 50 is positioned within the pipe receiving chamber 26, where it fits securely but does not frictionally engage the pipe receiving chamber 26. However, in other embodiments, the elongate smoking pipe 50 may be friction-fitted. The elongate smoking pipe 50 is best shown in FIGS. 4-6 and is discussed in more detail below. The smoking product receiving chamber 28 may be of different sizes and shapes to hold a desired quantity of the smoking product 29, and is adapted to keep the smoking product 29 secure and protected against contamination, getting wet, drying out, etc. The smoking product 29 may be in the form of any smoking product, e.g., cannabis flower, concentrates, waxes, resins, tobacco, etc., or other smokable materials.

Figure 3:
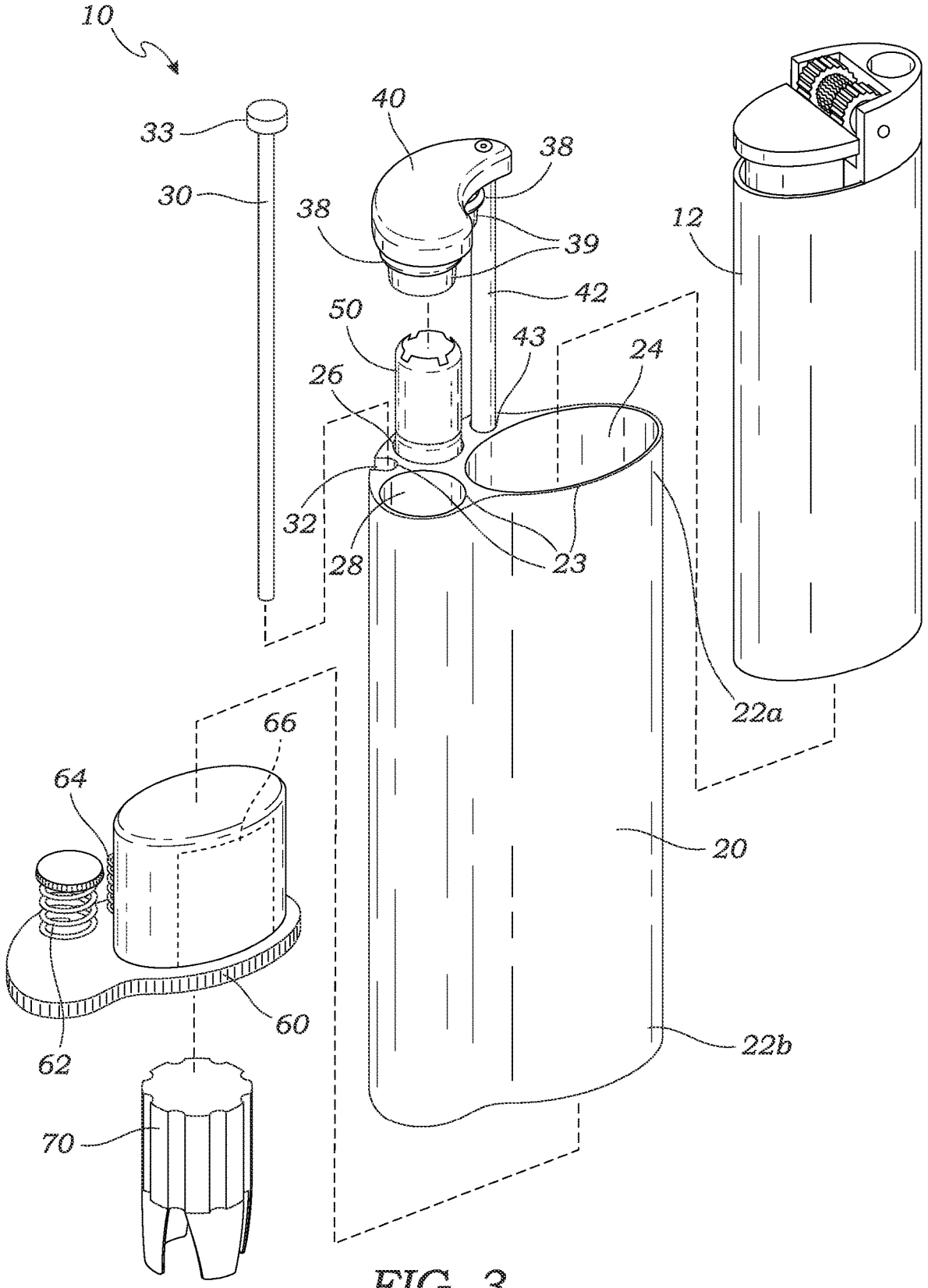
FIG. 3 is an exploded perspective view of the smoking storage device, showing all of the components of the device.

FIG. 3 is an exploded perspective view of the smoking storage device 10, and FIG. 4 is a sectional view of the smoking storage device 10. As shown in FIGS. 3-4, the overcap 40 may additionally include a sealing protrusion 38 having o-rings 39 for frictionally engaging the pipe receiving chamber 26 and/or the smoking product receiving chamber 28 when in the closed position. The o-rings 39 may help to functionally seal the chambers 26 and 28 to protect against moisture and prevent odor from escaping. Additionally, in this embodiment, the bottom end 22*b* of the main housing 20 may include a base 60, wherein the base 60 is securely attached to the bottom end 22*b* of the elongate rigid housing (e.g. bonded, welded, integrally formed, etc.). The base 60 may include a pipe spring 62 of the pipe receiving chamber 26 that biases the elongate smoking pipe 50 upwardly so that part of the elongate smoking pipe 50 will extend out of the pipe receiving chamber 26 when the overcap 40 is in the open position. The base 60 may also include a cap spring 64 that biases the mounting rod 42 upwardly when the locking feature 44 is used, as described above. The pipe spring 62 and the cap spring 64 may be in the form of a coil spring, or any other form of spring, resilient element, or biasing structure.

As shown in FIGS. 3-4, in this embodiment, a cap chamber 66 is formed in the base 60 and extends upwardly into the elongate main body, the cap chamber 66 being adapted to receive and store a vape cap 70, the vape cap 70 being discussed further below. In various embodiments, the cap chamber 66 may be a variety of shapes and sizes adapted to hold different vape cap shapes and designs. The vape cap 70 may frictionally engage with the cap chamber 66, or there may be a retaining mechanism such as a cover plate, inner tabs, etc. (not shown).

FIG. 5 is a sectional view of the elongate smoking pipe 50 of the smoking storage device 10. As shown in FIG. 5, the elongate smoking pipe 50 may be of standard construction, comprising a first end 52*a* and a second end 52*b*, wherein the first end 52*a* includes a first opening 54*a* to an inner conduit 56 that connects to a smoking product receiving cavity 58 of the second end 52*b*. As discussed, the elongate cleaning tool 30 shown in FIGS. 2-3 may be grasped to pull it from the elongate rigid housing for use in clearing out the inner conduit 56 of the elongate smoking pipe 50. Other accessories may be compatible with the elongate smoking pipe 50, e.g., a removable mouthpiece, a retaining cap, etc., or any other accessories adapted for this type of pipe.

In this embodiment, the smoking product receiving cavity 58 includes a mesh filter 55 between the inner conduit 56 and the receiving cavity 58, and further includes a second opening 54*b* opposite the mesh filter 55, for receiving the smoking product 29. In the present embodiment, the second opening 54*b* is irregular and tapers inwardly so a user may press it into the smoking product 29 of the smoking product receiving chamber 28 to more easily pick up smoking product 29. While one example of the opening is illustrated and described herein, other irregular shapes may be included, or the opening may be generally smooth. Furthermore, while one embodiment of the elongate smoking pipe 50 is shown and described, other configurations are possible, e.g., having finger grip portions of various shapes and materials, or wherein the receiving cavity 58 is wider than the rest of the elongate smoking pipe 50, etc., as is well-known in the art, and should be considered within the scope of the present invention.

FIG. 6 is a bottom perspective view of the smoking storage device 10, illustrating the elongate smoking pipe 50 being inserted into the vape cap 70 of the smoking storage device 10. As shown in FIG. 6, the vape cap 70 is mounted within the base 60 for easy access. The vape cap 70 may be removably mounted for easy insertion and removal. When being removed, the pipe may be used to pull the vape cap 70 from the cap chamber 66 (as illustrated), or the vape cap 70 may be removed via another means (e.g., a mechanism such as a spring-loaded element, switch, etc.). Equivalent structures known in the art are considered within the scope of the present invention. The present embodiment enables one-handed use of the vape pipe, which may be inserted into the vape cap 70, removed for use, and then re-inserted after use.

As shown in FIG. 6, the second end 52*b* of the elongate smoking pipe 50 may also include an annular bevel 59 for receiving a plurality of tabs 72 which extend inwardly from the vape cap 70 for a removable friction fit. The tabs 72 frictionally engage the annular bevel 59 of the elongate smoking pipe 50. Once the vape cap 70 is secured on the second end 52*b* of the elongate smoking pipe 50, the vape cap 70 may be pulled from the base 60, and then heated (e.g., with the lighter 12) to vaporize the smoking product 29 within the receiving cavity 58.

The vape cap 70 may further include thermal flutes 74 to reduce heating time. Additionally, in this embodiment, thermochromatic paint 68 is applied to the elongate smoking pipe 50, for indicating the desired temperature has been reached, to ensure the proper heat is used for vaporizing the smoking product 29. As shown in FIG. 3, in some embodiments, the thermochromatic paint 68 may be additionally or instead applied to the vape cap 70. In this embodiment, thermochromatic paint 68 which darkens or changes colors at 320 degrees is used to form 320 on the pipe, and another form of thermochromatic paint 68 is used to form 370 and 420 degrees. While one example of thermochromatic paint 68 is illustrated, other temperatures may be indicated, or the paint 68 may read "ready," "hot," etc., instead of precise temperature indicators.

The title of the present application, and the claims presented, do not limit what may be claimed in the future, based upon and supported by the present application. Furthermore, any features shown in any of the drawings may be combined with any features from any other drawings to form an invention which may be claimed.

As used in this application, the words "a," "an," and "one" are defined to include one or more of the referenced item unless specifically stated otherwise. The terms "approximately" and "about" are defined to mean+/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by claims made to the invention.

What is claimed is:

1. A smoking storage device for storing a lighter and a smoking product, the smoking storage device comprising:

an elongate housing having a top end and a bottom end, the top end having openings into a lighter receiving chamber, a pipe receiving chamber, and a smoking product receiving chamber, and wherein the bottom end is closed;

wherein the lighter receiving chamber is sized and shaped to receive the lighter;

wherein the pipe receiving chamber that contains an elongate smoking pipe;

wherein the smoking product receiving chamber is adapted to receive and store the smoking product; and an overcap pivotally mounted adjacent the top end of the elongate rigid housing, wherein the overcap pivots between a closed position and an open position, wherein in the closed position the overcap covers the opening of the pipe receiving chamber and the smoking product receiving chamber to hold the elongate smoking pipe and the smoking product within their respective chambers, and wherein in the open position the overcap does not cover the openings and allows access to the elongate smoking pipe and the smoking product;

wherein the overcap is mounted on an overcap mounting rod that slidably engages a mounting rod chamber of the elongate housing;

further comprising a cap spring in the mounting rod chamber that biases the overcap mounting rod upwardly so that the overcap is biased towards the open position; and wherein the overcap mounting rod includes a locking feature that locks the overcap in the closed position; wherein the locking feature of the overcap mounting rod includes a lateral protrusion that protrudes out of a slot formed in the main housing; wherein the lateral protrusion is formed on a resilient arm that is formed to extend from the mounting rod, so that the lateral protrusion can be pressed inwardly to an unlocked position, and it will resiliently return to a locked position.

2. The smoking storage device of claim 1, wherein a pipe spring is positioned within the pipe receiving chamber adjacent the bottom end to bias the elongate smoking pipe upwardly towards a raised position that is partially out of the pipe receiving chamber, to facilitate removal of the elongate smoking pipe when the overcap is in the open position.

3. The smoking storage device of claim 1, further comprising thermochromatic paint applied to the elongate smoking pipe, indicating the temperature reached during use for ensuring proper heat application.

4. The smoking storage device of claim 1, further comprising a vape cap mounted in a base of the main housing, wherein the elongate smoking pipe may be inserted into the vape cap.

5. The smoking storage device of claim 1, wherein the elongate smoking pipe comprises an annular bevel and vape cap comprises a plurality of tabs which extend inwardly from the vape cap for engagement with the annular bevel.

6. The smoking storage device of claim 5, wherein the vape cape includes thermal flutes for heating the smoking product within the elongate smoking pipe.

7. The smoking storage device of claim 1, further comprising a resilient plug that extends through an opening in the elongate housing and into the lighter receiving chamber, so that the resilient plug abuts and frictionally engages the lighter to prevent the lighter from accidentally falling out of the lighter receiving chamber.

8. The smoking storage device of claim 1, wherein each of the pipe receiving chamber, the smoking product receiving chamber, and the mounting rod chamber are all formed along parallel axes.

9. The smoking storage device of claim 1, wherein the elongate housing, and the pipe receiving chamber, the smoking product receiving chamber, and the mounting rod chamber, are all formed as a single extruded unit.

10. The smoking storage device of claim 1, wherein the resilient arm includes a lateral stop that also extends outwardly.

11. A smoking storage device comprising:

an elongate housing having a top end and a bottom end, the top end having openings into a lighter receiving chamber, a pipe receiving chamber, and a smoking product receiving chamber that contains a smoking product, and wherein the bottom end is closed;

wherein the lighter receiving chamber contains a lighter;

wherein the pipe receiving chamber contains an elongate smoking pipe, the elongate smoking pipe comprising a thermochromatic paint for indicating the temperature reached during use for ensuring proper heat application;

wherein the smoking product receiving chamber is adapted to receive and store the smoking product; and an overcap pivotally mounted adjacent the top end of the elongate rigid housing, wherein the overcap pivots between a closed position and an open position, wherein in the closed position the overcap covers the opening of the pipe receiving chamber and the smoking product receiving chamber to hold the elongate smoking pipe and the smoking product within their respective chambers, and wherein in the open position the overcap does not cover the openings and allows access to the elongate smoking pipe and the smoking product; wherein the overcap is mounted on an overcap mounting rod that slidably engages a mounting rod chamber of the elongate housing; further comprising a cap spring in the mounting rod chamber that biases the overcap mounting rod upwardly so that the overcap is biased towards the open position; wherein the overcap mounting rod includes a locking feature that locks the overcap in the closed position; wherein the locking feature of the overcap mounting rod includes a lateral protrusion that protrudes out of a slot formed in the main housing; wherein the lateral protrusion is formed on a resilient arm that is formed to extend from the mounting rod, so that the lateral protrusion can be pressed inwardly to an unlocked position, and it will resiliently return to a locked position.

* * * * *